US005499577A

United States Patent [19]

Tommasini

[11] Patent Number: 5,499,577

[45] Date of Patent: Mar. 19, 1996

[54] AUTOMATIC SELF-CLEANING ARRANGEMENT OF A COOKING OVEN

[75] Inventor: Stelvio Tommasini, Pordenone, Italy

[73] Assignee: Zanussi Grandi Impianti S.p.A., Pordenone, Italy

[21] Appl. No.: 331,720

[22] Filed: Oct. 31, 1994

[30] Foreign Application Priority Data

Nov. 4, 1993 [IT] Italy ..... PN93A0069

[51] Int. Cl.[6] ..... A47J 27/10

[52] U.S. Cl. ..... 99/476; 99/447; 126/21 A; 126/369; 134/95.3; 219/400

[58] Field of Search ..... 99/476, 474, 447; 219/400, 401; 126/369, 21 A, 20; 134/104.1, 95.1, 95.3, 166 R, 181; 366/138

[56] References Cited

U.S. PATENT DOCUMENTS

| | | | |
|---|---|---|---|
| 3,986,891 | 10/1976 | Rumbaugh | 99/340 |
| 4,448,117 | 5/1984 | Wells | 99/386 |
| 4,455,924 | 6/1984 | Wenzel | 99/482 |
| 4,506,598 | 3/1985 | Meister | 99/474 |
| 5,014,679 | 5/1991 | Childs et al. | 126/369 |
| 5,191,831 | 3/1993 | Walden | 99/446 |

*Primary Examiner*—David Scherbel
*Assistant Examiner*—Reginald L. Alexander
*Attorney, Agent, or Firm*—Pearne, Gordon, McCoy & Granger

[57] ABSTRACT

A food cooking oven has an access door (1), a cooking cavity (2), and a motor-driven fan (3) situated on the back side of the cooking cavity. A partition wall (4) is arranged to diffuse the air flow generate by the fan. A rear chamber (5) is situate behind the fan and is confined on its front side by the fan and the partition wall (4). The oven is provided with a conduit (6), an end portion of which terminates with a nozzle (7) positioned near the wheel of the fan (3). The other end portion of the conduit (6) is connected with a reservoir (8) and a pump (9) adapted to pump liquid contained in the reservoir into the conduit (6). The pump (9) and the fan (3) are connected to a control device (10) adapted to control their operation. A second conduit (17) has an outlet end portion terminating with a second nozzle (18) that is also arranged close to the fan (3).

12 Claims, 2 Drawing Sheets

AUTOMATIC SELF-CLEANING ARRANGEMENT OF A COOKING OVEN

BACKGROUND OF THE INVENTION

The present invention relates to a food cooking oven with fan-assisted operation which is adapted to perform cooking cavity cleaning automatically.

In the following description, reference is made, in particular, to a food cooking oven of the type intended for use in catering operations, professional kitchens and similar applications. It will, however, be appreciated that what is described and claimed in connection thereto in this patent actually applies to any kind of food cooking oven.

It is generally known that, during cooking of foodstuffs in an oven, and especially during fan-assisted operation of such an oven, the cooking cavity thereof is subject to quick and heavy soiling by splashes of food particles, juice, and gravy droplets. In particular, in the case of ovens with fan-assisted operation, air becomes impregnated with emanations (airborne soil) from the food being cooked and deposits them on the walls of the oven cavity. If a sufficiently high temperature is prevailing in the oven cavity, such particles being deposited on the walls thereof become thermally set thereon due to their burning and charring.

Such a soiling of the oven cavity is a wholly undesired effect, since it gives rise to a number of well-known drawbacks which are discussed hereafter only for the sake of a better understanding of the problem. First of all, the very presence of food remainders in the oven cavity brings about the possibility of decay and putrefaction thereof, with obvious risks of a hygienic and sanitary nature resulting therefrom. Furthermore, such food residues deposited onto the oven cavity walls, especially when they are not burned or charred, are generally subject to progressive deterioration as they go through subsequent cooking cycles in the oven cavity, and tend to dissolve by giving off fumes and unpleasant odors.

These drawbacks are generally tolerated to a certain extent when they relate to cooking ovens used in household applications, where there is no definite obligation set by external authorities governing the way in which oven cavities should be cleaned. However, even in household applications such a problem is being felt to such an extent that the solution consisting of providing the ovens with a so-called "self-cleaning" feature is widely known to have rapidly expanded in the marketplace. Presently, self-cleaning ovens are generally provided with plates that clad the oven cavity walls and are provided with a special pyrolytic coating. Upon conclusion of the actual cooking process, the temperature in these ovens is increased to a value of up to approximately 400° C., so that the pyrolytic coating is enabled to "burn off" and dissolve the food residues deposited on it.

Such a solution, however, suffers from a number of drawbacks. First of all, it requires a considerable use of energy to boost the temperature inside the cooking cavity to the required, typically high, self-cleaning value. Furthermore, this self-cleaning process has proven to be just partially effective, since it fails to remove possible soil particles that are not deposited directly on the pyrolytic plates. A third drawback results from the fact that self-cleaning plates with pyrolytic coatings are typically subject to become exhausted in a relatively quick way, thereby losing their self-cleaning property.

The problem of adequately keeping the inside of the oven cavity in a clean state is felt in a particularly acute way in the use of the ovens for cooking foods in catering establishments and professional kitchens in general. There, the need for systematically cleaning the cooking cavity arises both from definite requirements set by standard regulations and the fact that such ovens are typically subject to heavy-duty utilization. That is, they are used in an intensive way, many times each day throughout the year.

After each cooking cycle, the oven operator is required to clean the interior of the cooking cavity. A cooking cycle is, in this case, understood to mean a sequence or a certain number of subsequent cooking processes. A standardized method of cleaning the oven cavity consists of manually spraying a certain amount of very alkaline detergent substances onto the cavity walls, shutting the oven door and allowing the detergent substances to chemically attack the cooking residues to be removed for an adequate period of time, which typically cannot be shorter than approximately 15 minutes. Then the operator opens the oven door and manually cleans and rinses the cavity to remove the residues as decomposed by the detergent substances.

Such a cleaning method is usually very unpleasant for the oven operators due to the ill-smelling fumes and aggressive vapors that are emitted when the oven door is eventually opened to reach inside the cavity for cleaning. Furthermore, the subsequent rinsing phase, due to the fact that it must be performed by hand and generally requires a lot of time to be carried out, tends to make operators unavailable just when full personnel availability is required in the kitchen for food preparation purposes.

The need therefore arises to provide an oven, especially one capable of being use in commercial and institutional catering establishments, which is adapted to perform a fully automatic self-cleaning process in a most simple way. The oven should be cleaned without any involvement whatsoever of the operator, as well as without this implying any need to carry out any significant design and/or construction modifications in the ovens themselves.

SUMMARY OF THE INVENTION

The present invention provides an improved cooking oven construction which provides for the automatic application of cleaning and rinsing liquids on the oven cavity walls. More particularly, the present invention provides an oven having nozzles for spraying washing and rinsing liquids into the oven via a fan.

BRIEF DESCRIPTION OF THE DRAWINGS

The invention itself will be more clearly understood by reference to the following description and accompanying drawings, in which.

DETAILED DESCRIPTION OF THE PREFERRED EMBODIMENTS

Figure 1:
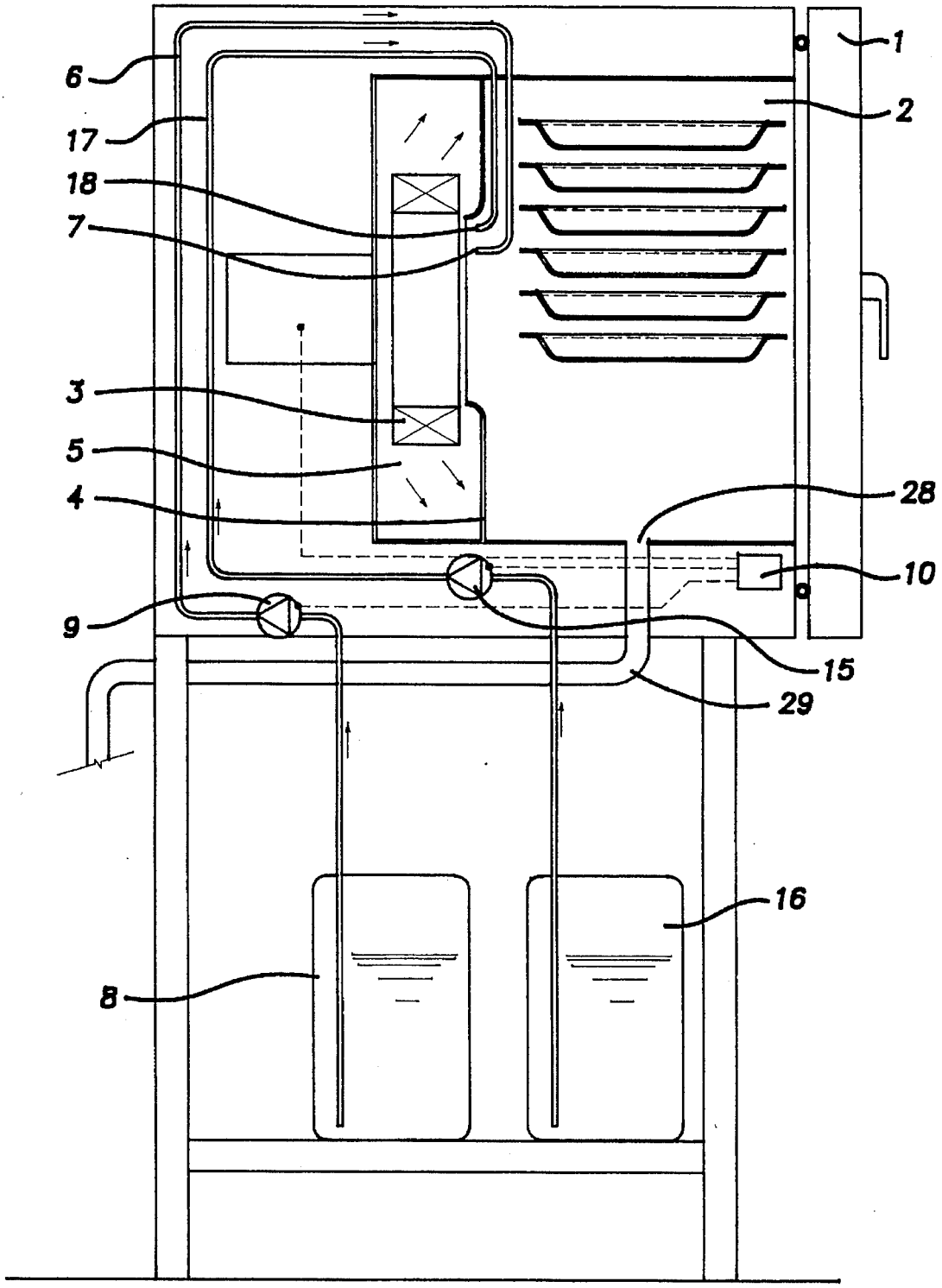
FIG. 1 is a side elevational view schematically showing a vertical section of a cooking oven according to the present invention.

Referring to FIG. 1, a food cooking oven as provided, in particular, for commercial and/or institutional catering applications is illustrated. This oven is shown to comprise an access door 1 for reaching inside a cooking cavity 2, a motor-driven fan 3 located on the back side of the cooking cavity, a partition wall 4 acting as a baffle to divide and convey the air flow generate by the fan 3, a rear chamber 5 situated behind the fan 3 and confined or limited on its front side by the fan 3 and partition wall 4.

The oven is also provided with a conduit 6, an end portion of which terminates with a nozzle 7 positioned near the wheel of the fan 3 which, preferably, is a tangential or radial type fan 3. The other end portion of the conduit 6 is connected with a reservoir 8 and includes a preferably priming-type pump 9 adapted to pump the liquid contained in the reservoir into and through the conduit 6.

Furthermore, both the pump 9 and the fan 3 are connected to a control arrangement 10 which is adapted to control their energization and de-energization according to criteria that will be explained hereafter in a more detailed.

The oven is, of course, provided with a number of further devices and component parts which, however, are substantially irrelevant as far as the actual purpose of this invention is concerned and shall therefore not be dealt with here any further.

The principle on which the operation of such an arrangement is based is as follows: at the beginning, the reservoir 8 is filled with a liquid substance that is capable of cleaning and dissolving the food residues deposited on the walls of the cooking cavity. Then, through a corresponding command sent from the control device 10, both the pump 9 and the fan 3 are energized and allowed to operate at the same time.

Due to the action of the pump 9, the liquid contained in the reservoir 8 is pumped through the conduit 6 towards the nozzle 7, from which it is sprayed against the blades of the fan 3. The fan 3 is therefore able to generate a turbulent flow which atomizes the liquid and transports it along the whole path covered by the flow when circulated normally. Thus, the liquid is deposited on those parts of the oven which constitute a path through which air flows and which delimits the flow.

It will by now be fully appreciated that such an effect is, in some respects, practically the same as the one which is achieved by manually spraying the detergent substances as previously described. With the arrangement according to the invention, however, an additional advantage is provided in that the sprayed jet of atomized detergent substance generated by the fan 3 is necessarily caused to exactly follow the path of normal air flow. Therefore, the sprayed jet of atomized detergent above all impinges against and deposits on those surfaces which are most heavily soiled, since they are the same surfaces that are mostly exposed to the flushing action of the flow of air mixed with cooking vapors, fumes, and food residues of various kinds circulated inside the oven cavity during the previously performed cooking process.

The result is therefore achieved that the most heavily soiled surfaces are exactly the ones that are automatically flushed by a greater amount of sprayed detergent substances, to an extent which is above all substantially proportional to their degree of soiling, as opposed to what was actually achievable with the previously used manual method which, of course, tended to enable the most effective cleaning action to take place on the most readily accessible surfaces, rather than the most heavily soiled ones.

Additionally, a further advantage of the invention derives also from the fact that, in the above described way, even the rear chamber 5 provided for the circulation of the air, which is generally not accessible without prior removal of the partition wall 4, is actually flushed by the spray of detergent substances.

The duration of the phase in which the detergent substances are delivered via the conduit 6 and the nozzle 7 to be sprayed by the fan 3 can be pre-determined at will, on the basis of various factors, by simply acting on the control device 10 accordingly. Upon conclusion of such a detergent delivery phase, a rinsing phase is then started for final removal of the food residues previously dissolved by the detergent substances.

This rinsing phase is carried out by de-energizing the pump 8 and starting a second pump 15, connected to the control device 10. The second pump 15 draws or pumps liquid from a second reservoir 16 filled with an appropriate rinsing liquid, such as water.

The pump 15 impels the rinsing liquid contained in the reservoir 16 into a second conduit 17, one end portion of which terminates at a second nozzle 18. The second nozzle 18 is also situated near the fan 3 and is adapted to spray a continuous jet of rinsing liquid against the rotating blades thereof.

At this point, due to the action of the rotating fan wheel, the jet of rinsing liquid undergoes an atomization process, after which it is then carried all along the normal air circulation path in the oven cavity, in a similar way as occurred in conjunction with the above-described process for the application of the detergent substance.

Such a mechanically forced flow of atomized rinsing liquid impinges against the soiled walls on which, however, the food residues and the soil in general had been previously dissolved and detached therefrom, and rinses the walls clean by flushing away the soiling residues towards a bottom of the oven cavity. From there they can then be removed in an automatic way by making use of an outlet opening 28 and a corresponding outlet conduit 29 that are normally already provided by such types of ovens.

The operation of the two pumps 9 and 15 and the fan 3 is controlled and synchronized by the control device 10 according to energization and de-energization sequences that can be defined in accordance with the desired results and can be programmed in advance in any one of a number of ways that are well-known to those skilled in the art. The control device 10 can then be actuated by the operator through a simple external control element, such as a button, knob or the like (not shown) located, for example, on the control panel of the oven.

Figure 2:
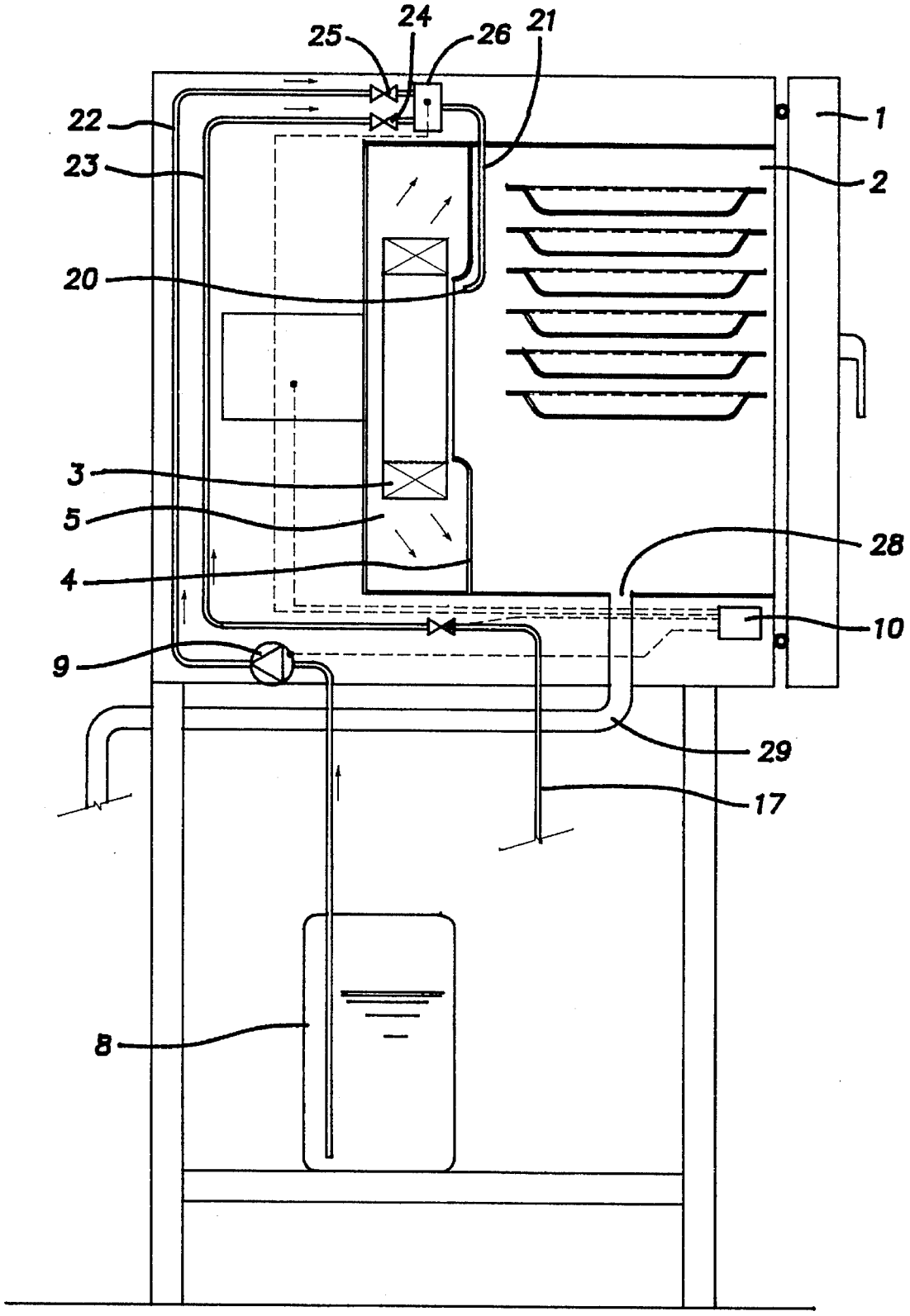
FIG. 2 is a side elevational view schematically showing a vertical section of a cooking oven according to a second embodiment of the present invention.

A second embodiment of the present invention is shown in FIG. 2, which illustrates an oven in which the nozzles provided for spraying the detergent substance and the rinsing liquid are joined into a single nozzle 20 coming out from a single conduit 21. At a certain point down along its path, the single conduit 21 divides into two separate branches 22 and 23 leading to the two separate reservoirs for the detergent substance and the rinsing liquor.

Furthermore, in order to prevent the single streams of liquid flowing from the two distinct reservoirs from flowing into the reservoir which is not in use at the moment, it is advantageous to provide an arrangement such as, for instance, check valves 24, 25, or solenoid valves (not shown) operated by the control device 10, on each branch 22, 23 of the conduit.

As an alternative solution thereto, a water flow diverter such as, for instance, a two-way solenoid valve 26 arranged in correspondence with the branch-off point of the conduit branches 22 and 23, can be provided.

A further advantageous variant to the above-described embodiments consists in eliminating both the reservoir 16 containing the rinsing liquid and the related pump 15. The conduit 17 is then connected directly to a water supply line or mains (not shown). In such a way, the advantage of a much simpler construction and an enhanced effectiveness in flushing away the soil residues is obtained due to the greater pressure available in the water supply mains as compared to the delivery pressure than can be obtained by the use of a small pump.

A further improvement that may be cited here by way of example can be achieved by joining the single nozzle 20 and the related conduit 21 together with a humidifier nozzle and conduit that are usually already provided in such an oven to let water into the cooking cavity during some particular phases of the cooking processes carried out therein.

Although the invention has been described on the basis of the example represented by some preferred embodiments thereof, and using a generally known terminology, the present invention cannot be considered as being limited by these, since anyone skilled in the ar will appreciate that a number of variations and modifications can be further made involving both construction and shape.

What is claimed is:

1. A food cooking oven comprising a cooking cavity, an access door closing said cavity, a motor-driven fan situated on a back side of said cooking cavity, a partition wall provided to diffuse air flow generated by said fan, a chamber accommodating said fan and defined in part by said partition wall, wherein the oven is provided with a conduit, a first end portion of said conduit having a nozzle disposed adjacent the fan and a second end portion of said conduit being divided into first and second distinct branches, said first branch being connected to a reservoir containing a detergent substance and said second branch being connected to a reservoir containing a rinsing liquid wherein said nozzle is adapted for spraying at least one of said detergent and said rinsing liquid onto said fan so as to be diffused into said cooking cavity.

2. A cooking oven according to claim 1, wherein each branch is provided with a device for preventing liquid from flowing towards the respective reservoirs.

3. A cooking oven according to claim 2, wherein said device is a check valve.

4. A cooking oven according to claim 1, wherein at a branch point of said branches of the conduit there is provided a two-way flow diverter.

5. A cooking oven according to claim 2, wherein said device is a solenoid valve.

6. A cooking oven according to claim 1, wherein said conduit is also adapted for use as a humidification conduit for admitting moisture into the cooking cavity during a cooking process.

7. A food cooking oven comprising a cooking cavity, an access door closing said cavity, a motor-driven fan situated on a back side of said cooking cavity, a partition wall provided to diffuse air flow generated by said fan, a chamber accommodating said fan and defined in part by said partition wall, wherein the oven is provided with a conduit, a first end portion of said conduit having a nozzle disposed adjacent the fan and a second end portion of said conduit being divided into first and second distinct branches, said first branch being connected to a reservoir containing a detergent substance and said second branch being connected to a water supply main wherein said nozzle is adapted for spraying at least one of said detergent and water from said supply main onto said fan so as to be diffused into said cooking cavity.

8. A cooking oven according to claim 7, wherein each branch is provided with a device for preventing liquid from flowing toward the respective reservoirs.

9. A cooking oven according to claim 8, wherein said device is a check valve.

10. A cooking oven according to claim 7, wherein at a branch point of said branches of the conduit there is provided a two-way flow diverter.

11. A cooking oven according to claim 8, wherein said device is a solenoid valve.

12. A cooking oven according to claim 7, wherein said conduit is also adapted for use as a humidification conduit for admitting moisture into the cooking cavity during a cooking process.

* * * * *